United States Patent [19]

Heren

[11] Patent Number: 5,005,767

[45] Date of Patent: Apr. 9, 1991

[54] SLITTED DIRT SEAL FOR INGROUND SPRINKLER HEADS

[75] Inventor: Lawrence P. Heren, Peoria, Ill.

[73] Assignee: L.R. Nelson Corporation, Peoria, Ill.

[21] Appl. No.: 398,277

[22] Filed: Aug. 24, 1989

[51] Int. Cl.[5] ..... B05B 15/00

[52] U.S. Cl. ..... 239/288; 239/205

[58] Field of Search ..... 239/288.5, 288, 201, 239/204, 206, 205, 203, 202, 104

[56] References Cited

U.S. PATENT DOCUMENTS

| | | | |
|---|---|---|---|
| 1,058,549 | 4/1913 | Cathcart | 239/204 |
| 1,259,902 | 3/1918 | Parker | 239/204 |
| 2,406,745 | 9/1946 | Curtze . | |
| 2,513,047 | 6/1950 | Pfeiffer . | |
| 3,282,508 | 11/1966 | Roberts . | |
| 3,752,403 | 8/1973 | Diest . | |
| 3,934,820 | 1/1976 | Phaup | 239/240 |
| 4,682,732 | 7/1987 | Walto | 239/206 |
| 4,752,033 | 6/1988 | Groendyke | 239/205 |

*Primary Examiner*—Andres Kashnikow

*Assistant Examiner*—Christopher G. Trainor

*Attorney, Agent, or Firm*—Cushman, Darby & Cushman

[57] ABSTRACT

A pop-up sprinkler head assembly for use during installation of an underground sprinkler system including a housing having an inlet for receiving water from an underground conduit and an open end extending upward from the inlet. The open end has an annular seal member which communicates with a pop-up body mounted within the housing. A compression spring biases the pop-up body in a first retracted position entirely within the housing and stresses in response to the movement of the pop-up body from the first retracted position to a second extended position partially extending from the housing. A shielding member releasably affixes to the housing in an aperture-shielding position and flexes outward in response to the movement of the pop-up body. When the pop-up body is in the first retracted position, such as after flushing and during installation operations, the shielding member isolates the interior of the housing from the unintended and unwanted deposit debris, dirt and the like.

15 Claims, 2 Drawing Sheets

SLITTED DIRT SEAL FOR INGROUND SPRINKLER HEADS

This invention relates to a novel pop-up sprinkler head assembly for use in an underground sprinkler system. More specifically, this invention relates to a pop-up sprinkler head assembly having improvements for use during installation and flushing of an underground sprinkler system.

Underground sprinkler systems generally comprise a plurality of pop-up sprinkler head assemblies connected to a buried network of water supply lines. Following installation procedures, the individual pop-up sprinkler head assemblies are fitted with an appropriate sprinkler nozzle constructed to disperse water in fixed spray patterns of 90, 180, 270 or 360 degrees. Thus, strategic placement of pop-up sprinkler head assemblies and selection of an appropriate accompanying sprinkler nozzle ensure adequate water delivery to all targeted areas.

The standard procedure for installing underground sprinkler systems entails connecting the pop-up sprinkler head assemblies to an underground water conduit, flushing the sprinkler system to expel loose dirt and/or debris from the interior channels of the system, and finally attaching an appropriate sprinkler nozzle to each individual sprinkler head assembly. Installing the sprinkler head assemblies prior to the attachment of the sprinkler nozzle expedites the installation procedure. If the sprinkler nozzles were attached to the sprinkler head assemblies and then the combination was installed as a single unit, dirt and/or debris could become lodged within the pop-up sprinkler head assembly while the combination was being connected to the underground water conduit. The sprinkler nozzle would subsequently need to be removed from the obstructed assembly to flush the system. Thus far, installing the sprinkler head assemblies and then, at a later time, attaching the sprinkler nozzles has proven to be the most effective and time-efficient installation process.

Pop-up sprinkler head assemblies commercially available in the marketplace generally include a pop-up body mounted within a housing and a compression spring positioned between the housing and the pop-up body. The housing has an inlet to receive water under pressure from an underground conduit. The housing further includes an open end which extends upward from the inlet to a posture substantially coplanar with the ground surface.

In the absence of water, the pop-up body is biased in a retracted position and securely retained within the housing by the compression spring. When the sprinkler system is activated, for example during a flushing procedure, water flows into the pop-up sprinkler head assembly and stresses the compression spring, thereby allowing the pop-up body to move upward to a position partially extending through the housing. The pop-up body includes a means for releasably attaching a sprinkler nozzle so that, following installation, an appropriate nozzle may be connected to the pop-up body.

During movement, the pop-up body slidably contacts an annular seal mounted within the housing. The interaction between the annular seal and the pop-up body creates an effective seal between the sprinkler head assembly and the environment. However, before the attachment of a nozzle and while the pop-up body resides within the housing, an aperture remains between the body and the annular seal through which dirt and/or debris may enter the interior channels of the system.

Normal procedure to expel the unintended and unwanted deposit of dirt within the system is to flush the system; however, for the duration of time following flushing and prior to the attachment of a sprinkler nozzle, no measure has been taken in the past to prevent debris from reentering the system and causing underground blockages. Further, an amount of dirt and/or debris insufficient to cause a complete blockage of the sprinkler system may still create a disfunction of one or more sprinkler head assemblies. In this connection, after attachment of a sprinkler nozzle, a relatively small volume of loose debris within a sprinkler head assembly may be sufficient to clog the sprinkler nozzle when the system is activated.

The difficulty suggested in the proceeding is not intended to be exhaustive but rather is one which may tend to reduce full operability of an underground sprinkler system. Other noteworthy problems may also exist; however, the disadvantage presented above should be sufficient to demonstrate that underground sprinkler systems known in the past will admit to worthwhile improvement.

It is therefore a general object of the invention to provide a novel pop-up sprinkler head assembly which will prevent dirt and/or debris from entering the underground sprinkler system during installation and following flushing. In accordance with the principles of the present invention, this objective is accomplished by providing a pop-up sprinkler head assembly which includes a shield removably secured to the housing in an aperture-shielding position. This shield may flex outward in response to the movement of the pop-up body from a first retracted position to a second extended position. The shield returns to the aperture-shielding position when the pop-up body retracts to the first position and thus isolates the housing and the pop-up body from debris, dirt and the like during installation operations and after flushing of the underground sprinkler systems. Further, the shield is inexpensive to manufacture and may be reused if multiple flushing procedures and/or installation operations are performed. In addition, the shield may remain attached to the housing up until attachment of the sprinkler nozzle to the pop-up body at which time the shield may be easily removed from the housing and discarded.

Other objects and advantages of the present invention will become apparent from the following detailed description of a preferred embodiment of the invention taken in conjunction with the accompanying drawings.

THE DRAWINGS

Figure 1:
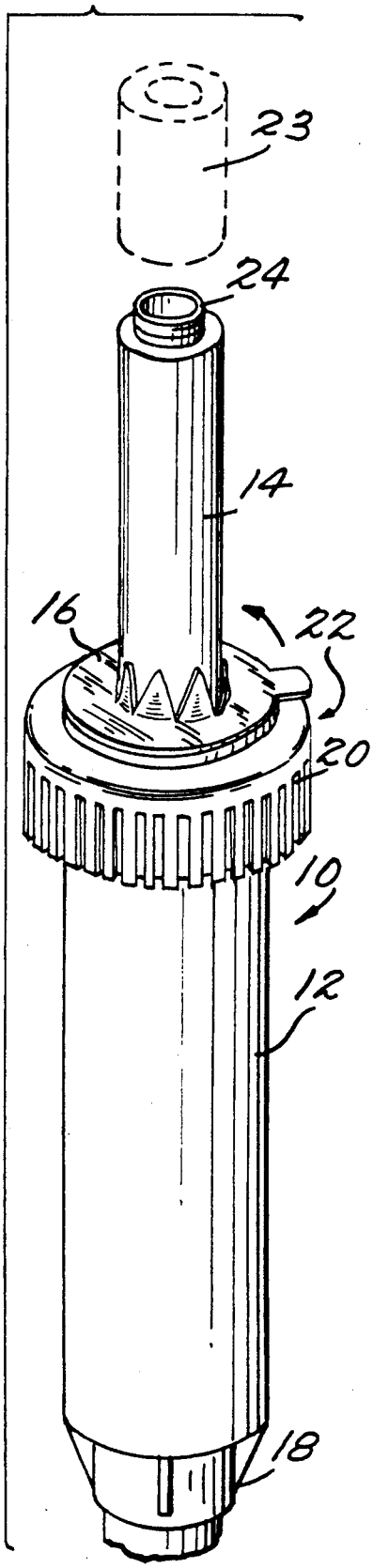
FIG. 1 is a perspective view of a pop-up sprinkler head assembly for use during installation of an underground sprinkler system which discloses an operative context of the present invention.

Referring now to the drawings, wherein like numerals indicate like parts, and initially to FIG. 1, there will be seen an operative context of the subject invention. More particularly, a pop-up sprinkler head assembly 10 is disclosed which is operable to be connected to an underground water distribution system. The sprinkler head assembly 10 is designed to attach to a lateral portion of the underground distribution system and extend upwardly in a posture such that an uppermost portion of the sprinkler head assembly 10 is substantially coplanar with the ground surface.

The pop-up sprinkler head assembly 10 includes a housing 12, a pop-up body 14, and a shield 16. In FIG. 1, the pop-up body 14 is shown in an upwardly extending position in response to the communication of water under pressure to an inlet 18 of the housing 12.

The housing 12 further includes a cap 20 which is releasably attached to an open end 22 of the housing 12. Further, the cap 20 has an aperture coaxial with the pop-up body 14 through which the pop-up body 14 may move from a first retracted position to a second extended position. The pop-up body 14 is operably constrained to rectilinear movement by the interaction between longitudinal ribs mounted on an interior wall of the housing 12 and receiving slots on the pop-up body 14 as known and implemented in conventional sprinkler head assemblies.

In operation, water flows from an underground conduit through the inlet 18 of the housing 12 and into a central channel 23 of the pop-up body 14. In response to the inflow of water, the pop-up body 14 extends from a first retracted position entirely within the housing 12 through the cap 20 to a second position at least partially extending from the housing 12. When the pop-up body 14 projects above the cap 20, the shield 16 flexes outward from an aperture-shielding posture to allow extension of the pop-up body 14. In this position, the pop-up sprinkler head assembly expels water such as during flushing of the underground sprinkler system.

Figure 3:
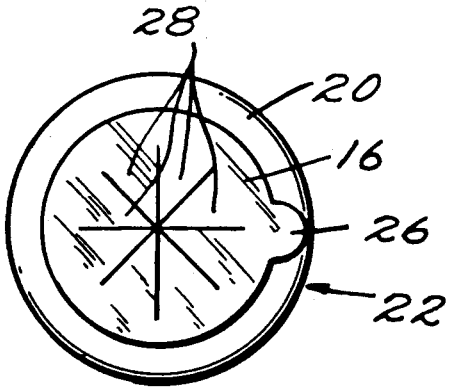
FIG. 3 is a top view of the pop-up sprinkler head assembly shown in FIG. 2 depicting a shield mounted on an open end of a housing in an aperture-shielding position.
Figure 2:
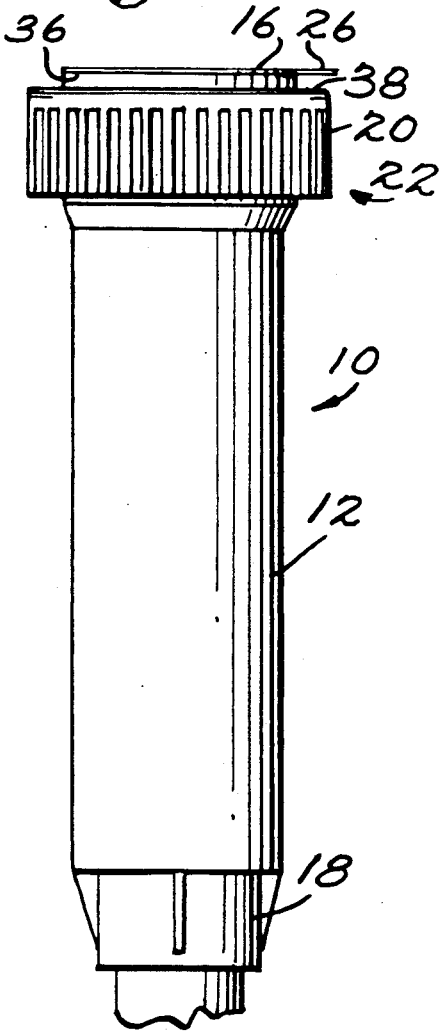
FIG. 2 is a side elevational view of the pop-up sprinkler head assembly shown in FIG. 1.

FIGS. 2 and 3 disclose the shield 16 in a closed posture which seals the interior channels of the housing means 12 from the unintended and unwanted deposit of debris. The shield 16 may be discarded upon installation of a sprinkler nozzle 23 to the nozzle attaching means 24, shown in FIG. 1, of the pop-up body 14.

Specifically referring to FIG. 2, a side view of the pop-up sprinkler head assembly 10 is shown with the shield 16 in an aperture-shielding position. The shield 16 includes a tab 26 radially mounted on a peripheral location of the shield 16 to facilitate tactile removal and discarding of the shield 16 following a flushing procedure and subsequent installation operations.

The shield 16 is preferably made of polycarbonate, but may be composed of any material having flexibility and memory characteristics. Further, the shield 16 may be cut from sheets of polycarbonate or the like or molded from the same. In the preferred embodiment shown, the shield 16 is cut from a sheet of polycarbonate so as to have an essentially circular periphery providing a marginal edge area arranged for detachable securement to the cup 20 and a central area which is cut to form a plurality of flexible segments 28. As shown, the cuts in the central area defining the segments 28 consist essentially of four radial cut lines which intersect at the center of the circular periphery and are displaced angularly with respect to one another in equally spaced relation (e.g. 45°). The radial extent of each straight cut from the center is slightly more than the radius of the pop-up body 14 or aperture defined by the annular seal 34.

Turning now to FIG. 3, a top view of the shield 16 is shown mounted in an aperture-shielding position on the cap 20. In a preferred embodiment, the shield 16 comprises a plurality of flexible segments 28 which are operable to flex outward and allow passage of the pop-up body 14 from the first retracted position to the second extended position. Also shown is the tab 26 located at a peripheral location on the shield 16.

Figure 4:
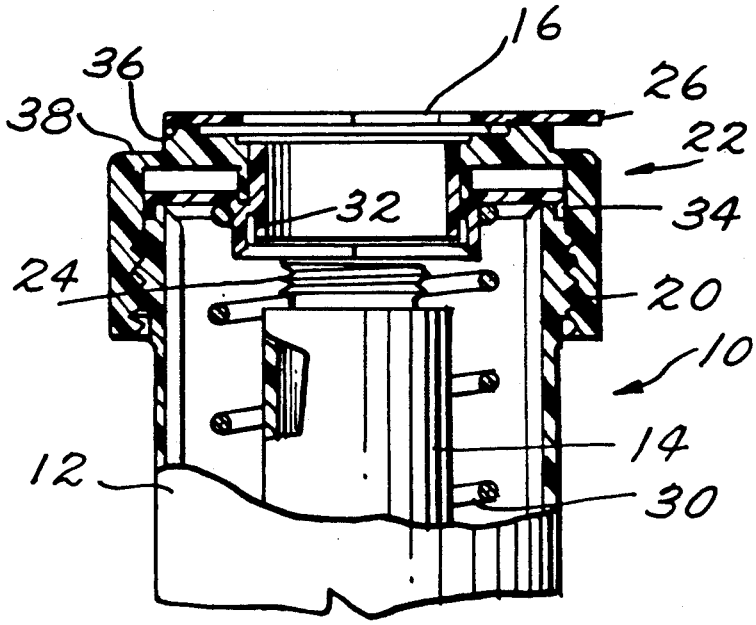
FIG. 4 is a cross-sectional view of the open end of the housing shown in FIG. 3 including an annular seal.

FIG. 4 discloses a cross-sectional detail view of an upper portion of the pop-up sprinkler head assembly 10. In the absence of water, the pop-up body 14 is biased in the first retracted position by a compression spring 30 leaving an aperture 32 between the pop-up body 14 and an annular seal 34. When water is introduced into the housing 12, the pop-up body 14 moves from a first retracted position to a second extended position. This movement is guided by an annular seal 34 which is located within the open end 22 of housing 12.

During the transition from the first position to the second position, the interaction between the pop-up body 14 and the annular seal 34 effectively isolates the interior of the housing 12 from the environment. However, if the pop-up body 14 was in the retracted position and the shield 16 was absent, dirt and/or debris could enter the underground sprinkler system through the aperture 32. The attachment of the shield 16 to the housing 12 creates a seal throughout the duration of the installation procedures including the periods when the pop-up body 14 is in the first retracted position.

Figure 5:
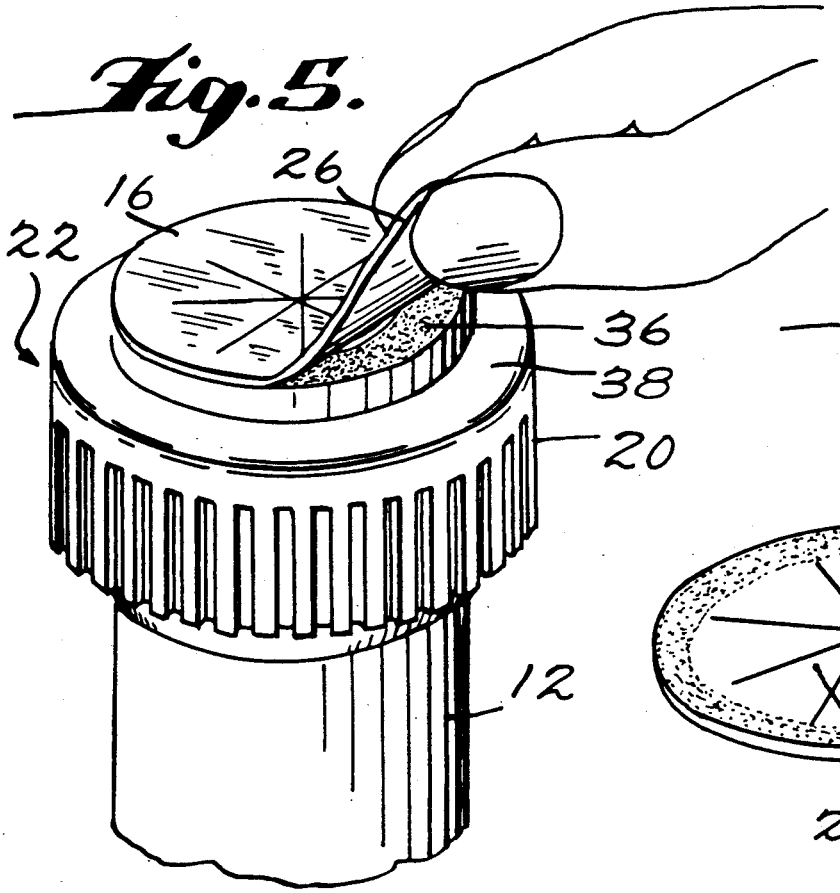
FIG. 5 is a perspective detail view disclosing removal of the shield following successful flushing of an underground sprinkler system.

FIG. 5 depicts removal of the shield 16 following successful installation procedures including flushing of the underground system. The shield 16 is removably secured to an axially extending annular face 36 which integrally extends from a peripheral rim 38 of the cap 20. An adhesive or the like is coated along the marginal edge area of the circular periphery of the shield 16 for attachment purposes. Manual removal of the shield 16 may be facilitated by grasping the tab 26 and pulling upward. The shield 16 may then be discarded, and an appropriate sprinkler nozzle may be fitted to the nozzle attaching means 24 of the pop-up body 14.

Figure 6:
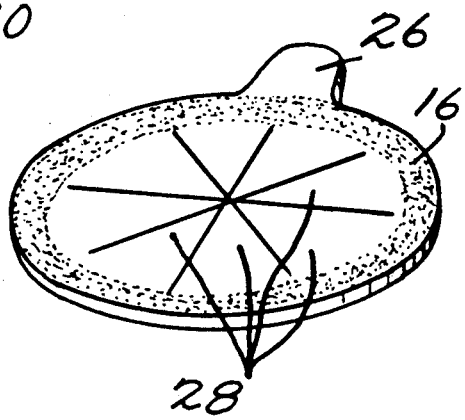
FIG. 6 is a perspective detail view of the bottom surface of a shield which has been removed from the open end of the housing via the technique depicted in FIG. 5.

FIG. 6 shows a bottom surface 40 of the shield 16 after removal from the housing 12. Also shown is a preferred embodiment of the shield 16 where the plurality of flexible elements 28 extend outward from the center of the shield 16 a distance approximately equal to the inner diameter of the axially extending annular face 36 of the cap 20.

After reading and understanding the foregoing description of a inventive pop-up sprinkler head assembly, in conjunction with the drawings, it will be appreciated that distinct advantages of the subject invention are obtained.

In brief sum, the major advantages of the invention include a unique shielding means 16 releasably affixed to a housing 12 for isolating the interior of the housing 12 from the unintended and unwanted deposit of debris, dirt and the like during installation and flushing of an underground sprinkler system.

Further, the plurality of flexible segments 28 are operable to flex outward and then return to an aperture-shielding position numerous times which allows the shielding means 16 to be reused if multiple flushing procedures and/or installation operations are performed.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which will fall within the purview of the subject invention and claims.

What is claimed is:

1. A pop-up sprinkler head and shield assembly for use during installation of an underground sprinkler system comprising:

a housing having, an inlet positioned in one portion of said housing operable to be communicated with water under pressure from an underground conduit of said underground sprinkler system, and an open end positioned in another portion of said housing having an annular seal means therein and, said open and extending upward from said inlet to a posture substantially coplanar with the ground surface when said housing is installed;

a pop-up body mounted within said housing for movement in cooperating relation with said annular seal means from a first retracted position within said housing to a second extended position extending upwardly from said housing in response to the communication of the water under pressure with said inlet of said housing;

said pop-up body having means for releasably securing a sprinkler nozzle in a position to cooperate with said annular seal means when said pop-up body is in said first retracted position to prevent debris from entering the pop-up body and the housing so that during installation when the sprinkler nozzle is unattached and the pop-up body is in said first retracted position there remains an aperture within said annular seal means through which debris may enter said pop-up body and said housing;

spring means for biasing said pop-up body into said first retracted position in absence of the water under pressure, said spring means being stressed in response to movement of said pop-up body from said first retracted position to said second extended position concurrent with the introduction of the water under pressure through said inlet of said housing; and shielding means removably secured to said housing in an aperture-shielding position and movable (1) out of said aperture-shielding position in response to the movement of said pop-up body from said first retracted position to said second extended position during a flushing operation of the installation and (2) back into said aperture-shielding position in response to movement of said pop-up body from said second extended position back into said first retracted position, said shielding means operably serving to close said aperture and isolate the interior of said housing and said pop-up body from the unintended and unwanted deposit of debris, dirt and the like after the flushing operation of the underground sprinkler system.

2. A pop-up sprinkler head and shield assembly as defined in claim 1 wherein said shielding means includes detaching means for facilitating manual removal of said shielding means from said housing following the flushing operation.

3. A pop-up sprinkler head and shield assembly as defined in claim 2 wherein said detaching means comprises a tab radially extended from a peripheral location of said shielding means to facilitate manual removal and discarding of said shielding means following the flushing operation and subsequent installation operations.

4. A pop-up sprinkler head and shield assembly as defined in claim 3 wherein said shielding means comprises a shield of sheet material centrally cut to provide a plurality of flexible segments operable to flex outward in response to the movement of said pop-up body from said first retracted position to said second extended position and being self-biased into a planar position to normally provide complete closure of said aperture.

5. A pop-up sprinkler head and shield assembly as defined in claim 4 wherein said shield of sheet material has an essentially circular periphery, the flexible segments being defined by four straight radially extending cut lines intersecting at the center of the circular periphery and being displaced angularly with respect to one another in equally spaced relation, the radial extent of the cut lines being slightly greater than said aperture.

6. A pop-up sprinkler head and shield assembly as defined in claim 5 wherein said sheet material is polycarbonate.

7. A pop-up sprinkler head end shield assembly as defined in claim 6 wherein the shield is removably secured to said housing by an adhesive applied to a marginal edge area of said shield.

8. A pop-up sprinkler head and shield assembly as defined in claim 7 wherein said housing further comprises cap means for releasable connection to said open end of said housing, said cap means having an aperture coaxial with said pop-up body and said annular seal means to permit movement of said pop-up body from said first retracted position to said second extended position therethrough.

9. A pop-up sprinkler head and shield assembly as defined in claim 8 wherein said cap means comprises a peripheral rim, and an axially extending annular face integrally extending from said peripheral rim.

10. A pop-up sprinkler head and shield assembly as defined in claim 1 wherein said shielding means comprises a shield of sheet material centrally cut to provide a plurality of flexible segments operable to flex outward in response to the movement of said pop-up body from said first retracted position to said second extended position and being self-biased into a planar position to normally provide complete closure of said aperture.

11. A pop-up sprinkler head and shield assembly as defined in claim 10 wherein said shield of sheet material has an essentially circular periphery, the flexible segments being defined by four straight radially extending cut lines intersecting at the center of the circular periphery and being displaced angularly with respect to one another in equally spaced relation, the radial extent of the cut lines being slightly greater than said aperture.

12. A pop-up sprinkler head and shield assembly as defined in claim 11 wherein said sheet material is polycarbonate.

13. A pop-up sprinkler head and shield assembly as defined in claim 12 wherein the shield is removably secured to said housing by an adhesive applied to a marginal edge area of said shield.

14. A pop-up sprinkler head and shield assembly as defined in claim 1 wherein said housing further comprises cap means for releasable connection to said open end of said housing, said cap means having an aperture coaxial with said pop-up body and said annular seal means to permit movement of said pop-up body from said first retracted position to said second extended position therethrough.

15. A pop-up sprinkler head and shield assembly as defined in claim 14 wherein said cap means comprises a peripheral rim, and an axially extending annular face integrally extending from said peripheral rim.

* * * * *